US011780709B2

(12) United States Patent
Li et al.

(10) Patent No.: US 11,780,709 B2
(45) Date of Patent: Oct. 10, 2023

(54) ELEVATOR COMMISSIONING METHOD, ELEVATOR COMMISSIONING SYSTEM, AND ELEVATOR SYSTEM

(71) Applicant: Otis Elevator Company, Farmington, CT (US)

(72) Inventors: Changle Li, Shanghai (CN); Buyun Jing, Shanghai (CN); Haitao Zhou, Shanghai (CN); Yun Li, Shanghai (CN); Keyu Li, Shanghai (CN); Xing Cai, Shanghai (CN); Daniel A. Mosher, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1093 days.

(21) Appl. No.: 16/539,070

(22) Filed: Aug. 13, 2019

(65) Prior Publication Data

US 2020/0048046 A1 Feb. 13, 2020

(30) Foreign Application Priority Data

Aug. 13, 2018 (CN) ..... 201810915478.5

(51) Int. Cl.
*B66B 13/14* (2006.01)
*B66B 1/34* (2006.01)
*B66B 5/00* (2006.01)

(52) U.S. Cl.
CPC ..... *B66B 13/146* (2013.01); *B66B 1/3423* (2013.01); *B66B 1/3461* (2013.01); *B66B 5/0018* (2013.01)

(58) Field of Classification Search
CPC ... B66B 13/146; B66B 1/3423; B66B 1/3461; B66B 5/0018; B66B 1/3407; B66B 5/0006; B66B 19/00; B66B 13/143; B66B 5/0037
See application file for complete search history.

(56) References Cited

U.S. PATENT DOCUMENTS 7,338,176 B2 3/2008 Svensson-Hilford et al.
7,423,398 B2 9/2008 Tyni et al.
(Continued)

FOREIGN PATENT DOCUMENTS

CN 101258087 B 6/2010
CN 102112388 A 6/2011
(Continued)

OTHER PUBLICATIONS

Chinese Office Action for Application No. 201810915478.5; dated May 11, 2022; 9 Pages.
(Continued)

*Primary Examiner* — Jeffrey Donels
(74) *Attorney, Agent, or Firm* — CANTOR COLBURN LLP

(57) ABSTRACT

The present invention relates to a method and a system of commissioning elevator, and an elevator system. The method includes obtaining at least one operation data of at least one elevator door, comparing the operation data with corresponding criterion operation data, and determining whether a deviation between the operation data and the criterion operation data exceeds a pre-set range, and if so, triggering a control over at least one control end relevant to the operation of the elevator door to make a deviation between the operation data re-obtained and the criterion operation data fall within the pre-set range. The invention will increase the efficiency in elevator commissioning and remove the adverse effects on elevator operation caused by factors such as "Stack Effect", and thereby ensure good working condition and high security of elevators.

19 Claims, 2 Drawing Sheets

(56) References Cited

U.S. PATENT DOCUMENTS

| | | | | |
|---|---|---|---|---|
| 7,823,706 | B2 | 11/2010 | Tyni et al. | |
| 8,447,433 | B2 | 5/2013 | Reynolds | |
| 10,315,885 | B2 * | 6/2019 | Kinnari | B66B 19/007 |
| 11,518,650 | B2 * | 12/2022 | Witczak | B66B 13/143 |
| 2007/0016332 | A1 | 1/2007 | Tyni et al. | |
| 2015/0284214 | A1 | 10/2015 | Park et al. | |
| 2016/0280509 | A1 | 9/2016 | Sonnenmoser et al. | |
| 2017/0029244 | A1 * | 2/2017 | Madarasz | B66B 5/0037 |
| 2017/0197804 | A1 | 7/2017 | Kattainen et al. | |
| 2017/0320703 | A1 | 11/2017 | Sonnenmoser et al. | |
| 2017/0349404 | A1 | 12/2017 | Sonnenmoser et al. | |
| 2018/0079622 | A1 | 3/2018 | Sirigu et al. | |
| 2018/0086605 | A1 | 3/2018 | Saarela et al. | |

FOREIGN PATENT DOCUMENTS

| | | | |
|---|---|---|---|
| CN | 105659536 | A | 6/2016 |
| CN | 106115401 | A | 11/2016 |
| CN | 106163958 | A | 11/2016 |
| CN | 105452139 | B | 11/2017 |
| CN | 108382937 | A | 8/2018 |
| EP | 2562614 | | 2/2013 |
| EP | 3293137 | A1 | 3/2018 |
| EP | 3333110 | A1 | 6/2018 |
| KR | 20130027328 | A | 3/2013 |
| WO | 2017081113 | A1 | 5/2017 |

OTHER PUBLICATIONS

European Search Report for application EP 19191510.7, dated Apr. 9, 2020, 42 pages.

* cited by examiner

ELEVATOR COMMISSIONING METHOD, ELEVATOR COMMISSIONING SYSTEM, AND ELEVATOR SYSTEM

FOREIGN PRIORITY

This application claims priority to Chinese Patent Application No. 201810915478.5, filed Aug. 13, 2018, and all the benefits accruing therefrom under 35 U.S.C. § 119, the contents of which in its entirety are herein incorporated by reference.

FIELD OF THE INVENTION

The present invention relates to the technical field of elevator, especially to a method of commissioning elevator, a system of commissioning elevator and an elevator system.

BACKGROUND

Elevators are already used quite widely in modern society, bringing enormous conveniences to the work and daily life of people. Elevator commissioning may ensure elevator installation quality to enable operations of elevators to arrive at design requirements. However, current operations of elevator commissioning are so complicated and tedious, which require a lot of time, manpower and material resources. For example, in the prior art, the commissioning work for elevator doors may be rather time consuming and labor intensive. The problems are more prominent to many elevator doors mounted in respective floors of high-rise buildings. Moreover, in one aspect, elevator doors mounted in high-rise buildings might be affected by environmental factors such as "Stack Effect"; in another aspect, they will also be continuously affected by prolonged operation. All of these are likely to cause adverse changes in the operation conditions of elevator doors.

SUMMARY OF THE INVENTION

In view of the foregoing, the present invention provides a method of commissioning elevator, a system of commissioning elevator, and an elevator system, in order to address or at least relieve one or more of the above-described problems existing in the prior art and problems in other aspects.

Firstly, according to a first aspect of the present invention, a method of commissioning elevator is provided, which comprises: obtaining at least one operation data of at least one elevator door; comparing the operation data with corresponding criterion operation data; and determining whether a deviation between the operation data and the criterion operation data exceeds a pre-set range, and if so, triggering a control over at least one control end relevant to the operation of the elevator door to make a deviation between the operation data re-obtained and the criterion operation data fall within the pre-set range.

Optionally, in the method of commissioning elevator according to the invention, it further comprises the step of forming a comparison information of the operation data and the criterion operation data into a report, and transmitting the report to a monitoring end disposed on a local or cloud platform.

Optionally, in the method of commissioning elevator according to the invention, the operation data is obtained according to an instruction sent from an elevator controller, or from a cloud platform or a mobile terminal in communicative connection with the elevator.

Optionally, in the method of commissioning elevator according to the invention, the operation data is provided by a sensor for detecting the operation of the elevator door, and/or by the control end.

Optionally, in the method of commissioning elevator according to the invention, the control includes an amendment to control logic and/or a parameter of the control end.

Optionally, in the method of commissioning elevator according to the invention, the operation data includes door-opening speed, door-opening acceleration, door-closing speed, door-closing acceleration, current of an elevator door motor, and torque of an elevator door motor.

Optionally, in the method of commissioning elevator according to the invention, the criterion operation data varies according to different elevator floors.

Optionally, in the method of commissioning elevator according to the invention, the control end includes an elevator door controller, an elevator controller and an elevator door motor, and/or the elevator door is at least one of floor door and elevator car door.

Optionally, in the method of commissioning elevator according to the invention, the criterion operation data is preset or obtained by a self-learning way.

Furthermore, according to a second aspect of the present invention, a system of commissioning elevator is provided, which comprises: a data obtaining module for obtaining at least one operation data of at least one elevator door; a comparison processing module in connection with the data obtaining module, for comparing the operation data with corresponding criterion operation data to determine whether a deviation between the operation data and the criterion operation data exceeds a pre-set range; and a control module in connection with the comparison processing module, for triggering a control over at least one control end relevant to the operation of the elevator door when the deviation exceeds the pre-set range, to make a deviation between the operation data re-obtained and the criterion operation data fall within the pre-set range.

Optionally, in the system of commissioning elevator according to the invention, it further comprises a report module in connection with the comparison processing module, for forming a comparison information of the operation data and the criterion operation data into a report, and transmitting the report to a monitoring end disposed on a local or cloud platform.

Optionally, in the system of commissioning elevator according to the invention, the data obtaining module is configured to obtain the operation data according to an instruction sent from an elevator control, or from the cloud platform or a mobile terminal in communicative connection with the elevator.

Optionally, in the system of commissioning elevator according to the invention, the data obtaining module is configured to obtain the operation data from a sensor relevant to the operation of the elevator door, and/or from the control end.

Optionally, in the system of commissioning elevator according to the invention, the control of the control module over the control end includes an amendment to control logic and/or a parameter of the control end.

Optionally, in the system of commissioning elevator according to the invention, the operation data includes door-opening speed, door-opening acceleration, door-closing speed, door-closing acceleration, current of an elevator door motor and torque of an elevator door motor.

Optionally, in the system of commissioning elevator according to the invention, the criterion operation data varies according to different elevator floors.

Optionally, in the system of commissioning elevator according to the invention, the control end includes an elevator door controller, an elevator controller and an elevator door motor, and/or the elevator door is at least one of floor door and elevator car door.

Optionally, in the method of commissioning elevator according to the invention, the criterion operation data is preset or obtained by a self-learning way.

Furthermore, according to a third aspect of the present invention, it provides an elevator system comprising any one of the system of commissioning elevator as described above.

From the following descriptions in combination with figures, one will clearly understand the principles, characteristics, features and advantage of various technical solutions of the present invention. For example, it will be understood that, in comparison with the prior art, the present invention can bring out distinct advantages, which may not only complete elevator commissioning work quickly, efficiently and accurately with the increased efficiency, but also save considerable time, manpower and costs. Moreover, the invention may accurately determines an elevator door that has deviated from the normal operation state and subsequently, it may perform automatic commissioning to restore the elevator door's normal operation state; as such, adverse effects on elevator operation caused by factors such as "Stack Effect" will be successfully eliminated, and good working condition and high security of elevators will be ensured.

BRIEF DESCRIPTION OF THE DRAWINGS

The technical solutions of the present invention will be further described in detail below in conjunction with the drawings and embodiments. However, it should be understood that the drawings are designed merely for illustrative purpose and are intended only to conceptually explain the configurations described herein. It is unnecessary to draw the drawings in proportion.

DETAILED DESCRIPTION OF THE INVENTION

First of all, it should be noted that steps, configurations, compositions, features and merits of a method of commissioning elevator, a system of commissioning elevator and an elevator system according to the invention will be illustrated hereinafter by way of examples. However, all the descriptions should not impose any limitation to the present invention.

Moreover, as for any single technical feature described or implied in embodiments mentioned herein, or any single technical feature described or implied in each figure, the present invention still allows, without any technical difficulties, any combination or deletion of these technical features (or equivalents), such that it should be considered that more such embodiments according to the invention are within the scope of the disclosure contained in the application. In the context, the terms like "... end" or "... module" include any elements, devices or apparatuses that allow the implementation through their hardware, software or the combination.

Figure 1:
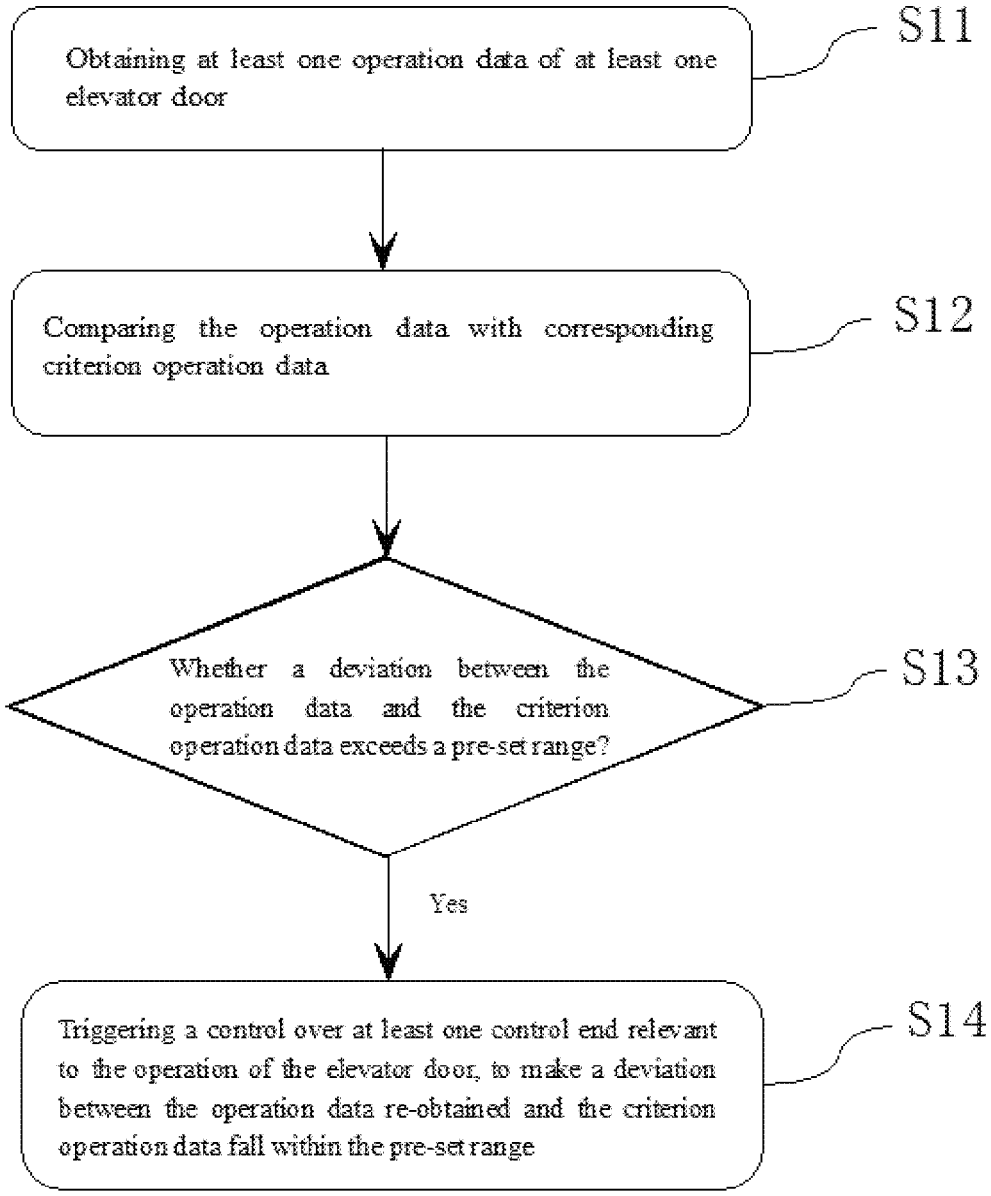
FIG. 1 is a schematic flow chart illustrating an embodiment of the method of commissioning elevator according to the invention.

Referring to FIG. 1, it illustrates a method of commissioning elevator according to the invention, by way of an example. As an illustration, the method example may comprise the following steps: Firstly, in step S11, one or more operation data of at least one elevator door in the elevator system is required. The operation data may includes, but are not limited to, door-opening speed, door-opening acceleration, door-closing speed, door-closing acceleration, current of an elevator door motor, torque of an elevator door motor, etc. Since the operation data as such may reflect the current operation state of an elevator door, analysis may be employed to determine whether or not the elevator door is in a normal operation state or has some problem disabling it to meet the requirement of design. Specific explanations will be given in the following parts.

It should be understood that the above-described elevator door may not only be a floor door, but also be an elevator car door or simultaneously includes a floor door and an elevator car door. Also, the elevator door as such any be located on any floor of a building in which the elevator installed. That is to say, in a practical application, one may separately obtain, according to specific requirements, one or more operation data of any one, several or all floor doors or elevator car doors of floors, and may simultaneously obtain one or more operation data of each of these floor doors or elevator car doors for analyzing and determining the current operation state of the floor doors and/or elevator car doors and then, to possibly take subsequent measures for processing.

Next, in step S12, the above obtained operation data of an elevator door are compared with corresponding criterion operation data; and, in step S13, whether the deviation between the operation data and the criterion operation data exceeds a pre-set range will be determined, wherein the range may be an absolute parameter value (e.g., 0.1 m/s, 0.01 mA, 10 N·m, etc.), and may also be a relative value (e.g., 2%, 1/20, etc.), and a value range expressed by an absolute parameter value or a relative value (e.g., 0.1 m/s-0.5 m/s, 2%-5%, etc.). Moreover, without deviation from the purport of the present invention, the pre-set range is allowed to be set, changed or adjusted flexibly according to specific application conditions.

As for the above criterion operation data, any proper form may be employed for provision in advance or by a self-learning way, as a criterion for analysis and comparison with the obtained elevator door operation data. By way of an example, the criterion operation data may be in various forms, such as curve graph, numerical model (that may be constituted by a suitable modeling tool in the prior art), data sample table, single value (i.e., the above-described absolute value or relative value) and value range.

Furthermore, the criterion operation data may be obtained from the producers, providers and/or design institutions of elevator systems or corresponding parts, devices or apparatus of elevators, or obtained by means of experiments or tests, or derived from relevant standards of corresponding countries, regions, industry organizations or enterprises. Of course, such criterion operation data may also be obtained by a self-learning way. For example, a self-learning way may be used to analyze the historical data of all elevator doors within a building over a period of time, so that the curves of a normal and an abnormal elevator door can be learned and a self-learning reference curve can be obtained, which may be used as a criterion operation data. Additionally, in a practical application, when a self-learning way is adopted, operation feature(s) may be extracted based upon newly added operation data. If the operation feature(s) newly extracted does not exist in the existing operation feature database, the addition of the feature(s) to the existing operation feature database may further optimize the self-learning way and therefore provide more complete, accurate and reliable criterion operation data.

Further, it should be understood that, since an elevator door might involve various types of operation data (e.g., door-opening speed, door-opening acceleration, door-closing speed, door-closing acceleration, current of an elevator door motor, torque of an elevator door motor, etc.), there could be a plurality of corresponding types of criterion operation data as comparison criteria to correspond to the elevator operation data, respectively.

Furthermore, the above-described criterion operation data may optically vary according to different elevator floors. For example, in terms of elevators installed in high-rise buildings, they are possibly affected by environmental factors such as "Stack Effect", and elevator doors installed on different floors might finally form deviations of various degrees relative to design requirements. Accordingly, different criterion operation data may be provided, by presetting or a self-learning way, for different floors, so as to meet practical requirements better, and enable different floors self-adaptively to complete elevator door commissioning with different parameter criteria and to further deal with influences and changes caused by "Stack Effect" and other aspects more specifically and efficiently.

Subsequently, in step S14, if it is determined that the deviation between the obtained operation data and the corresponding criterion operation data exceeds a pre-set range, a control over a control end will be triggered to change elevator door operations and elevator door commissioning will be completed by automatically performing the control as such so as to change the operation of elevator doors, and to make the deviation between the operation data that is re-obtained and the criterion operation data controlled in the pre-set range. As such, the elevator door commissioning will be automatically completed so rapidly and efficiently, and thereby not only the operation state of an elevator door will recover to meet the design requirements fast and accurately, but also the entire commissioning process will be convenient and time-saving, preventing the condition in the prior art that a great much time, manpower and material resources need to be consumed in elevator commissioning.

Without deviating from the purport of the present invention, any suitable components, devices or apparatuses capable of changing the purpose of elevator operation may be used as the above-described control end. For example, such a control end may include, but not be limited to, an elevator controller, an elevator controller, an elevator door motor, etc.

Furthermore, a number of modes may be optionally employed to control the above-described control end so as to enable the control result to change elevator door operations and finally be reflected from the obtained operation data of the elevator door.

For instance, the above-described control may be exerted by varying the original control logic of the control end, e.g., with a certain or some step sequences being adjusted, simplified or deleted in an elevator door controller, the amended control logic may change the operation data such as door-opening speed, door-opening acceleration, door-closing speed, door-closing acceleration, current of an elevator door motor and torque of an elevator door motor, so as to make the deviation between the re-obtained operation data and the criterion operation data not exceed the pre-set range, i.e., the operation of elevator doors will be ensured to meet the desired design requirements of operations.

For another instance, the above-described control may be realized by varying one or more parameters of the control end. The parameters as such may be those causing influence in the operation of an elevator door, such as output current and output torque of an elevator door motor.

Furthermore, the above control may be realized by simultaneously amending the control logic and/or a parameter of two or more control ends (e.g., elevator door controller, elevator controller, elevator door motor, etc.) in any possibly combined way. Accordingly, it would be likely to fulfill the above discussed purposes more efficiently, rapidly and flexibly.

In some embodiments, an additional step may be added: forming the above discussed the comparison information of operation data and criterion operation data into a report and, subsequently, transmitting the report to a monitoring end that may be arranged locally (i.e., in a building or its vicinities) or on a cloud platform. The report may simply record operation data and criterion operation data, but also may be a diagnosis report formed after data comparison. And, the report as such may be transmitted to the control end for storage, data analysis and processing, data sharing, etc.

It should be noted that, when, for example, a lot of data derived from each elevator system of different buildings are accumulated in the control end on a cloud platform, these data may be analyzed farther and systemically through various technical means such as big data analysis so as to offer more valuable, sufficient and effective services for elevator commissioning, e.g., it is possible to form and provide, more accurately and adaptively, all types of criterion operation data and a variety of control means over a control end by constant optimizations and modifications.

Optionally, a variety of means may be applied to obtain elevator door operation data. For example, the operation data of elevators may be obtained according to an instruction sent from an elevator controller. For another example, the wired mode (e.g., IoT, Bluetooth, Wi-Fi, 4G/5G, etc.), the wireless mode or the combination may be employed to the communicative connection between an elevator and a cloud platform; next, the operation data of elevators may be obtained according to an instruction sent from the cloud platform. For a further example, operation data of an elevator door may be obtained according to an instruction sent from a mobile terminal. The mobile terminal may be a hand-held commissioning terminal provided for concerned persons, or an APP for elevator commissioning installed directly in mobile communication devices such as a mobile phone.

Moreover, in terms of elevator door operation data themselves, they could be not only derived from all types of sensors configured to detect elevator door operations, but also provided by one or more control ends aforesaid.

Figure 2:
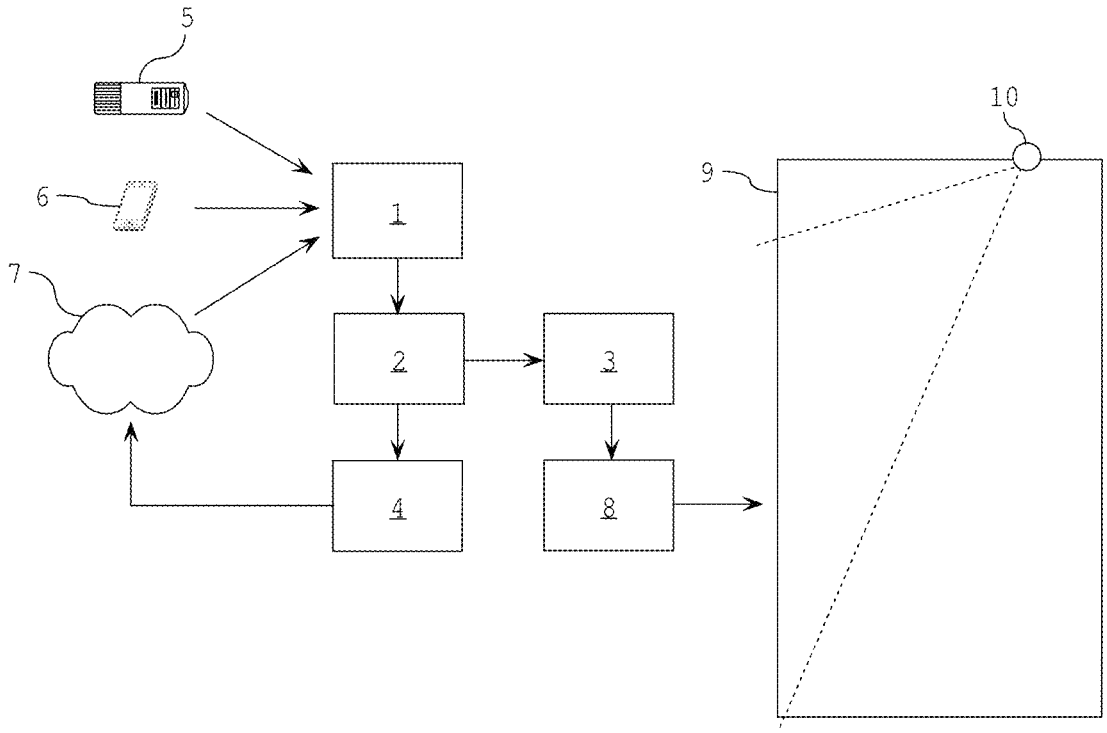
FIG. 2 is an illustration of an embodiment of performing elevator commissioning by means of an example of the system of commissioning elevator according to the invention.

For better understanding of the technical solution of the present invention, by way of an example, FIG. 2 substantially illustrates an example of an elevator commissioning, wherein an embodiment of system of commissioning elevator according to the present invention is employed.

As illustrated in FIG. 2 embodiment, the system of commissioning elevator includes a data obtaining module 1, a comparison processing module 2, a control module 3 and a report module 4.

The data obtaining module 1 is configured to obtain one or more operation data of at least one elevator door (e.g., door-opening speed, door-opening acceleration, door-closing speed, door-closing acceleration, current of an elevator door motor, torque of an elevator door motor, etc.). The operation data as such will be used by the comparison processing module 2 in connection with the data obtaining module 1 to be compared with criterion operation data, so as to determine whether the deviation between the operation data and the criterion operation data exceeds a pre-set range.

Subsequently, in the case that it is determined that the deviation between the operation data and the criterion operation data exceeds a pre-set range, the control module 3 in connection with the comparison processing module 2 will trigger the control over one or more control ends 8 (which is relevant to the operation of elevator door 9; that is, the operation state/operation data of elevator door 9 may be varied by the control over control ends 8) so as to make the deviation between the re-obtained operation data and the criterion operation data within the pre-set range. For example, the aforesaid control may be exerted by means of amending the control logic and/or a parameter of control ends 8.

As illustrated in FIG. 2, optionally, the data obtaining module 1 may obtain the operation data of elevator door 9 according to an instruction sent by an elevator controller 5, a mobile terminal 6 or a cloud platform 7. The operation data may be provided by sensors 10 for detecting the operation of the elevator door 9. These sensors 10 may be arranged in any proper positions inside or outside an elevator car, the concrete number, positions, coverage, work parameters and the like of which may be chosen, changed and adjusted flexibly according to practical application conditions. Moreover, the aforesaid operation data may also be provided by the control ends 8 that are components, devices or apparatuses relevant to elevator door operations, including, but not limited to, elevator door controller, elevator controller, elevator door motor. For example, the elevator controller 5 illustrated in FIG. 2 may be used as the control end 8.

Furthermore, a report module 4 is further set in the embodiment of FIG. 2, which is connected with the comparison processing module 2 and intended for forming the comparison information of the aforesaid operation data and criterion operation data into a report and, subsequently, transmitting the report to a monitoring end arranged locally or on the cloud platform 7.

It is understandable that, elaborations are given to the technical contents, such as the elevator door and its operation data, the criterion operation data, the pre-set range, the control over control ends, the monitoring end, the cloud platform and the mobile terminal when the introduction of the method of commissioning elevator of the invention is made in the preceding text in combination with FIG. 1. Therefore, references may be made directly to the corresponding parts of preceding text for specific descriptions, and no redundant description will be given here.

Since the method and the system of commissioning elevator of the invention can bring prominent advantages over the prior art, they are suitable for the applications to elevator systems for overcoming the defects and shortcomings existing in the prior art and mentioned in the preceding text. For instance, another technical solution of the present invention provides an elevator system, in which the system of commissioning elevator designed and provided according to the present invention is configured, e.g., the system of commissioning elevator may be integrated into an elevator controller or other proper components or devices of the elevator system, whereby the above-described prominent advantages of the technical solutions of the present invention can be presented.

The method of commissioning elevator, the system of commissioning elevator and the elevator system according to the present invention are explained above by way of examples, which are merely intended for the purpose of explaining the principle and implementing means of the present invention, rather than limiting it. Without a deviation from the spirit and scope of the invention, one skilled in the art may further make a variety of modifications and improvements. Therefore, all equivalent to technical solutions should belong to the scope of the present invention, and be covered by all the claims of the invention.

What is claimed is:

1. A method of commissioning elevator, comprising:

obtaining at least one operation data of at least one elevator door;

comparing the operation data with corresponding criterion operation data; and determining whether a deviation between the operation data and the criterion operation data exceeds a pre-set range, and if so, triggering a control over at least one control end relevant to the operation of the elevator door to make a deviation between the operation data re-obtained and the criterion operation data fall within the pre-set range;

wherein the control includes a change to at least one of control logic and a parameter of the control end.

2. The method of commissioning elevator according to claim 1, further comprising forming a comparison information of the operation data and the criterion operation data into a report, and transmitting the report to a monitoring end disposed on a local or cloud platform.

3. The method of commissioning elevator according to claim 1, wherein the operation data is obtained according to an instruction sent from an elevator controller, or from a cloud platform or a mobile terminal in communicative connection with the elevator.

4. The method of commissioning elevator according to claim 1, wherein the operation data is provided by at least one of a sensor for detecting the operation of the elevator door and the control end.

5. The method of commissioning elevator according to claim 1, wherein the criterion operation data varies according to different elevator floors.

6. The method of commissioning elevator according to claim 1, wherein the control end includes at least one of an elevator door controller, an elevator controller and an elevator door motor.

7. The method of commissioning elevator according to claim 1, wherein the criterion operation data is preset or obtained by a self-learning way.

8. The method of commissioning elevator according to claim 1, wherein the at least one elevator door is at least one of floor door and elevator car door.

9. A method of commissioning elevator, comprising:

obtaining at least one operation data of at least one elevator door;

comparing the operation data with corresponding criterion operation data; and determining whether a deviation between the operation data and the criterion operation data exceeds a pre-set range, and if so, triggering a control over at least one control end relevant to the operation of the elevator door to make a deviation between the operation data re-obtained and the criterion operation data fall within the pre-set range;

wherein the operation data includes at least one of door-opening speed, door-opening acceleration, door-closing speed, door-closing acceleration, current of an elevator door motor, and torque of an elevator door motor.

10. A system of commissioning elevator, comprising:

a data obtaining module for obtaining at least one operation data of at least one elevator door;

a comparison processing module in connection with the data obtaining module, for comparing the operation data with corresponding criterion operation data to determine whether a deviation between the operation data and the criterion operation data exceeds a pre-set range; and a control module in connection with the comparison processing module, for triggering a control over at least one control end relevant to the operation of the elevator door when the deviation exceeds the pre-set range, to make a deviation between the operation data re-obtained and the criterion operation data fall within the pre-set range;

wherein the control of the control module over the control end includes a change to at least one of control logic and a parameter of the control end.

11. The system of commissioning elevator according to claim 10, further comprising: a report module in connection with the comparison processing module, for forming a comparison information of the operation data and the criterion operation data into a report, and transmitting the report to a monitoring end disposed on a local or cloud platform.

12. The system of commissioning elevator according to claim 10, wherein the data obtaining module is configured to obtain the operation data according to an instruction sent from an elevator control, or from the cloud platform or a mobile terminal in communicative connection with the elevator.

13. The system of commissioning elevator according to claim 10, wherein the data obtaining module is configured to obtain the operation data from at least one of a sensor relevant to the operation of the elevator door and the control end.

14. The system of commissioning elevator according to claim 10, wherein the operation data includes at least one of door-opening speed, door-opening acceleration, door-closing speed, door-closing acceleration, current of an elevator door motor and torque of an elevator door motor.

15. The system of commissioning elevator according to claim 10, wherein the criterion operation data varies according to different elevator floors.

16. A system of commissioning elevator, comprising:

a data obtaining module for obtaining at least one operation data of at least one elevator door;

a comparison processing module in connection with the data obtaining module, for comparing the operation data with corresponding criterion operation data to determine whether a deviation between the operation data and the criterion operation data exceeds a pre-set range; and a control module in connection with the comparison processing module, for triggering a control over at least one control end relevant to the operation of the elevator door when the deviation exceeds the pre-set range, to make a deviation between the operation data re-obtained and the criterion operation data fall within the pre-set range;

wherein the control end includes at least one of an elevator door controller, an elevator controller and an elevator door motor.

17. The system of commissioning elevator according to claim 10, wherein the criterion operation data is preset or obtained by a self-learning way.

18. An elevator system, comprising the system of commissioning elevator according to claim 10.

19. The system of commissioning elevator according to claim 10, wherein the at least one elevator door is at least one of floor door and elevator car door.

* * * * *